US005852973A

United States Patent [19]

Kessler

[11] Patent Number: 5,852,973

[45] Date of Patent: Dec. 29, 1998

[54] PORTABLE, MANUALLY ACTUATED MAIL BAR CODE STAMP

[76] Inventor: Ronald P. Kessler, 5261 Bordeaux, Irvine, Calif. 92714

[21] Appl. No.: 826,566

[22] Filed: Apr. 4, 1997

[51] Int. Cl.[6] ..... B41J 27/02

[52] U.S. Cl. ..... 101/105; 101/103

[58] Field of Search ..... 101/111, 334, 101/333, 105, 104, 103, 108, 106, 109, 110, 405

[56] References Cited

U.S. PATENT DOCUMENTS

| | | | |
|---|---|---|---|
| 2,273,816 | 2/1942 | Boekeloo | 101/103 |
| 2,939,390 | 6/1960 | Clausing | 101/105 |
| 3,241,482 | 3/1966 | Keck | 101/111 |
| 4,854,235 | 8/1989 | Lyon | 101/389.1 |
| 5,237,919 | 8/1993 | Kinstrey et al. | 101/111 |
| 5,287,807 | 2/1994 | Johnston | 101/334 |
| 5,623,875 | 4/1997 | Perets | 101/104 |
| 5,649,485 | 7/1997 | Dour et al. | 101/334 |

FOREIGN PATENT DOCUMENTS

| | | | |
|---|---|---|---|
| 242197 | 11/1925 | United Kingdom | 101/333 |

*Primary Examiner*—Edgar S. Burr
*Assistant Examiner*—Anthony H. Nguyen

[57] ABSTRACT

A portable, manually actuated mail bar code stamp including a hand-held, portable housing and an adjustable bar code printing assembly situated within the housing. The printing assembly is adapted to allow the printing of indicia on an envelope. The indicia includes a plurality of linear protrusions that are spaced and parallel with respect to each other. The linear protrusions have a first length and a second length thereby representing a coded equivalent of a zip code and routing number for facilitating the delivery of mail.

2 Claims, 4 Drawing Sheets

| NUMERIC VALUE | BINARY CODE VALUE 74210 | BARCODE VALUE 74210 |
|---|---|---|
| 1 | 0011 | |
| 2 | 00101 | |
| 3 | 00110 | |
| 4 | 01001 | |
| 5 | 01010 | |
| 6 | 01100 | |
| 7 | 10001 | |
| 8 | 10010 | |
| 9 | 10100 | |
| 0 | 11000 | |

36

62
30
63
6
14
58
12
60
24
22
42
52
44
40
46
50
18
64
66
67
48
68

PORTABLE, MANUALLY ACTUATED MAIL BAR CODE STAMP

BACKGROUND OF THE INVENTION

1. Field of the Invention

The present invention relates to a portable, manually actuated mail bar code stamp and more particularly pertains to manually stamping a selected mail bar code on an envelope.

2. Description of the Prior Art

The use of date stamps is known in the prior art. More specifically, date stamps heretofore devised and utilized for the purpose of stamping a current date on correspondence are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,359,932 to Van Breene; U.S. Pat. No. 4,852,489 to Wall et al.; U.S. Pat. No. Des. 323,527 to Weir et al.; U.S. Pat. No. 4,841,860 to Fehling; U.S. Pat. No. 4,432,281 to Wall et al.; and U.S. Pat. No. 4,854,235 to Lyon.

In this respect, the portable, manually actuated mail bar code stamp according to the present invention substantially departs from the conventional concepts and designs of the prior art, and in so doing provides an apparatus primarily developed for the purpose of manually stamping a selected mail bar code on an envelope.

Therefore, it can be appreciated that there exists a continuing need for a new and improved portable, manually actuated mail bar code stamp which can be used for manually stamping a selected mail bar code on an envelope. In this regard, the present invention substantially fulfills this need.

SUMMARY OF THE INVENTION

In view of the foregoing disadvantages inherent in the known types of date stamps now present in the prior art, the present invention provides an improved portable, manually actuated mail bar code stamp. As such, the general purpose of the present invention, which will be described subsequently in greater detail, is to provide a new and improved portable, manually actuated mail bar code stamp which has all the advantages of the prior art and none of the disadvantages.

To attain this, the present invention essentially comprises a housing with a lower portion having a front face, a rear face, and a pair of lower side faces coupled therebetween defining an interior space, a bottom opening, a top opening and upper side openings. As shown in FIGS. 1 & 2, the front face has a rectangular cut out formed therein at a lower extent thereof. The lower side faces each have a generally vertical serpentine slot formed therein. The front face and rear face extend beyond the side faces for defining a pair of lips and a slot extending outwardly from the side faces. The housing further has an upper portion with a top face and a pair of side faces defining a bottom opening. The top face has a T-shaped handle integrally coupled thereto at a central extent thereof. The side faces each have a horizontal slot formed at a lower extent thereof. The side faces are adapted to be slidably situated within the slots of the lower portion of the housing. Next provided is a bar code printing assembly including a first axle coupled between a bottom extent of the side faces of the lower portion of the housing and a plurality of pulleys rotatably coupled in coaxial alignment along the first axle. Each pulley has a radially extending flange coupled thereto for allowing manual rotation of the pulley through the rectangular cut out of the lower portion of the housing. The printing assembly further includes a second axle having ends situated through the serpentine slot of the lower portion of the housing and the horizontal slot of the upper portion of the housing. A plurality of elastomeric bands are situated about an associated pulley and the second axle. The bands having a smooth interior surface and an exterior surface with different indicia formed therein. See FIG. 3. It should be noted that the indicia includes a plurality of linear protrusions that are spaced and parallel with respect to each other. The linear protrusions have either a first length or a second length. By selectively ordering such protrusions of first and second lengths, the indicia may be used to represent a sequence of numbers in accordance with the rules and definitions of the United States Post Office. As such, the sequence of numbers may be selected to thereby afford a coded equivalent of a zip code and routing number for facilitating the delivery of mail. Upon the rotation of the flange of a pulley, the associated band is moved thereby allowing the selective positioning of one of the indicia of the band adjacent the second axle. At this point, the upper portion of the housing may be lowered with respect to the lower portion thereof thereby precessing the second axle about the first axle and positioning the second axle and the indicia of the bands in the bottom opening of the lower portion of the housing. This allows the indicia to be inked and stamped on an envelope.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable, manually actuated mail bar code stamp which has all the advantages of the prior art date stamps and none of the disadvantages.

It is another object of the present invention to provide a new and improved portable, manually actuated mail bar code stamp which may be easily and efficiently manufactured and marketed.

It is a further object of the present invention to provide a new and improved portable, manually actuated mail bar code stamp which is of a durable and reliable construction.

An even further object of the present invention is to provide a new and improved portable, manually actuated mail bar code stamp which is susceptible of a low cost of manufacture with regard to both materials and labor, and which accordingly is then susceptible of low prices of sale to the consuming public, thereby making such portable, manually actuated mail bar code stamp economically available to the buying public.

Still yet another object of the present invention is to provide a new and improved portable, manually actuated mail bar code stamp which provides in the apparatuses and methods of the prior art some of the advantages thereof, while simultaneously overcoming some of the disadvantages normally associated therewith.

Still another object of the present invention is to manually stamp a selected mail bar code on an envelope.

Lastly, it is an object of the present invention to provide a new and improved portable, manually actuated mail bar code stamp including a hand-held, portable housing and an adjustable bar code printing assembly situated within the housing. The printing assembly is adapted to allow the printing of indicia on an envelope. The indicia includes a plurality of linear protrusions that are spaced and parallel with respect to each other. The linear protrusions have a first length and a second length thereby representing a coded equivalent of a zip code and routing number for facilitating the delivery of mail.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
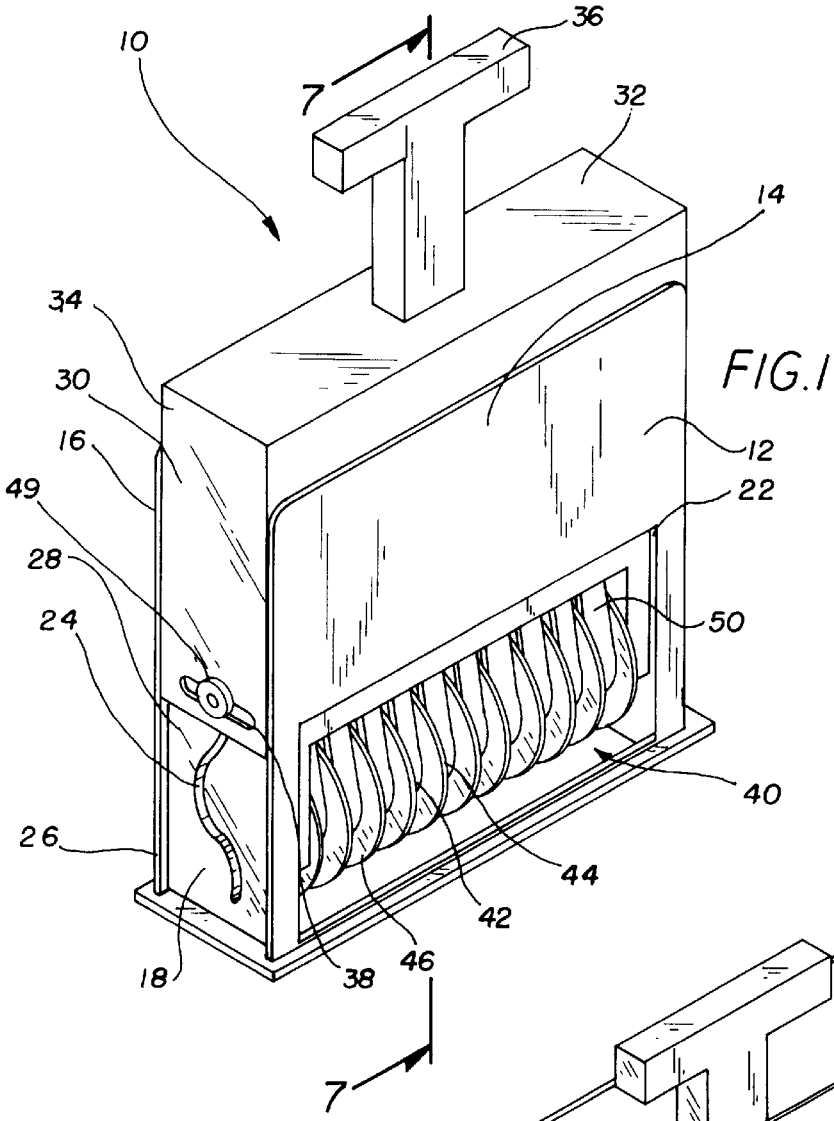
FIG. 1 is a perspective illustration of the preferred embodiment of the portable, manually actuated mail bar code stamp constructed in accordance with the principles of the present invention.

With reference now to the drawings, and in particular to FIG. 1 thereof, a new and improved portable, manually actuated mail bar code stamp embodying the principles and concepts of the present invention and generally designated by the reference numeral 10 will be described.

The present invention, the new and improved portable, manually actuated mail bar code stamp, is comprised of a plurality of components. Such components in their broadest context include a housing and printing assembly. Such components are individually configured and correlated with respect to each other so as to attain the desired objective.

Figure 2:
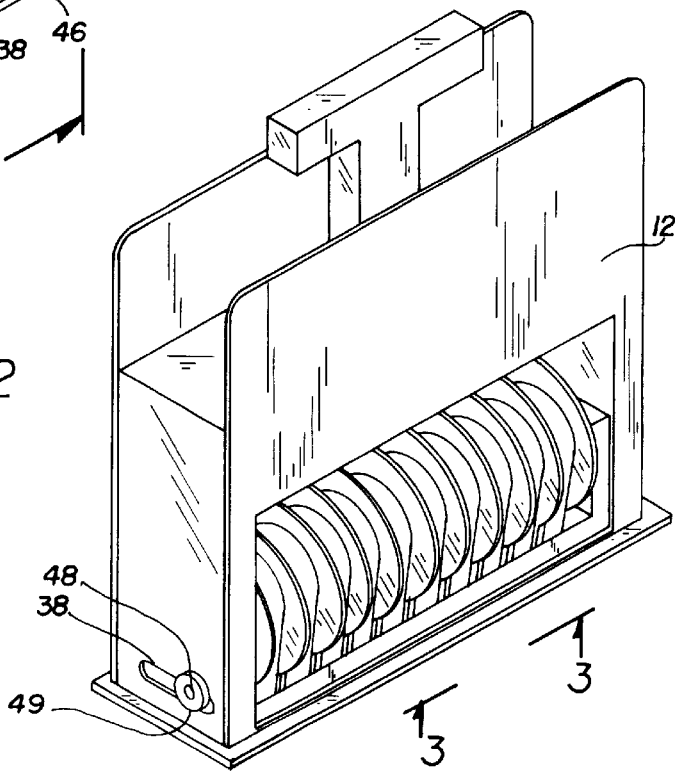
FIG. 2 is a perspective illustration of the present invention in a lowered orientation for printing.

More specifically, it will be noted that the system 10 of the present invention includes a housing with a lower portion 12 having a front face 14, a rear face 16, and a pair of lower side faces 18 coupled therebetween defining an interior space, a bottom opening, a top opening and upper side openings. As shown in FIGS. 1 & 2, the front face has a rectangular cut out 22 formed therein at a lower extent thereof. The lower side faces each have a generally vertical serpentine slot 24 formed therein. The front face and rear face extend beyond the side faces for defining a pair of lips 26 and a slot 28 extending outwardly from the side faces.

The housing further has an upper portion 30 with a top face 32 and a pair of side faces 34 defining a bottom opening. The top face has a T-shaped handle 36 integrally coupled thereto at a central extent thereof. The side faces each have a horizontal slot 38 formed at a lower extent thereof. The side faces are adapted to be slidably situated within the slots of the lower portion of the housing.

Figures 3, 4:
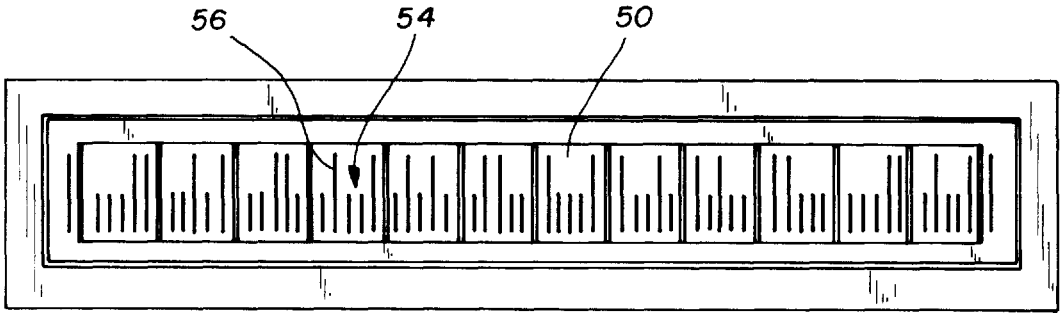
FIG. 3 is bottom view of the printing assembly taken along line 3—3 shown in FIG. 2.
FIG. 4 is a table delineating the numerical definitions of the bar codes utilized by the United States Post Office and the present invention.

Next provided is a bar code printing assembly 40 including a first axle 42 coupled between a bottom extent of the side faces of the lower portion of the housing. A plurality of pulleys 44 are rotatably coupled in coaxial alignment along the first axle. Each pulley has a radially extending flange 46 coupled thereto for allowing manual rotation of the pulley through the rectangular cut out of the lower portion of the housing. The printing assembly further includes a second axle 48 having ends situated through the serpentine slot of the lower portion of the housing and the horizontal slot of the upper portion of the housing. The second axile is maintained in its operative orientation by means of a pair of washers 49 situated on ends of thereof. A plurality of elastomeric bands 50 are situated about an associated pulley and the second axle. The bands having a smooth interior surface and an exterior surface 52 with different indicia 54 formed therein along the length thereof. See FIG. 3. In the preferred embodiment, at least 12 bands are included.

It should be noted that the indicia includes a plurality of linear protrusions 56 that are spaced and parallel with respect to each other. The linear protrusions have either a first length or a second length. By selectively ordering such protrusions of first and second lengths, each indicia may be used to represent a number in accordance with the rules and definitions of the United States Post Office. As such, a sequence of numbers may be selected via the indicia to thereby afford a coded equivalent of a zip code and routing number for facilitating the delivery of mail. In the preferred embodiment, 5 protrusions constitute each indicia. Further, 10 indicia are included on each band for representing 10 numbers between 0–9. In use, each band is adapted to print the 5 associated protrusions that are presently situated adjacent the second axle. Since 12 bands are included, 60 protrusions, or 12 indicia, are printed during each stamping, in accordance with the rules and definitions of the United States Post Office. It should be understood that such number does not include a pair of frame bits that are printed at both the beginning and the end of the sequence. Such may be accomplished by means of a protrusion formed on bottom ledges of the present invention. See FIG. 3.

Upon the rotation of the flange of a pulley, the associated band is moved thereby allowing the selective positioning of one of the indicia of the band adjacent the second axle. At this point, the upper portion of the housing may be lowered with respect to the lower portion thereof thereby precessing the second axle about the first axle and positioning the second axle and the indicia of each band in the bottom opening of the lower portion of the housing. This allows the indicia to be inked and stamped on an envelope.

Figure 7:
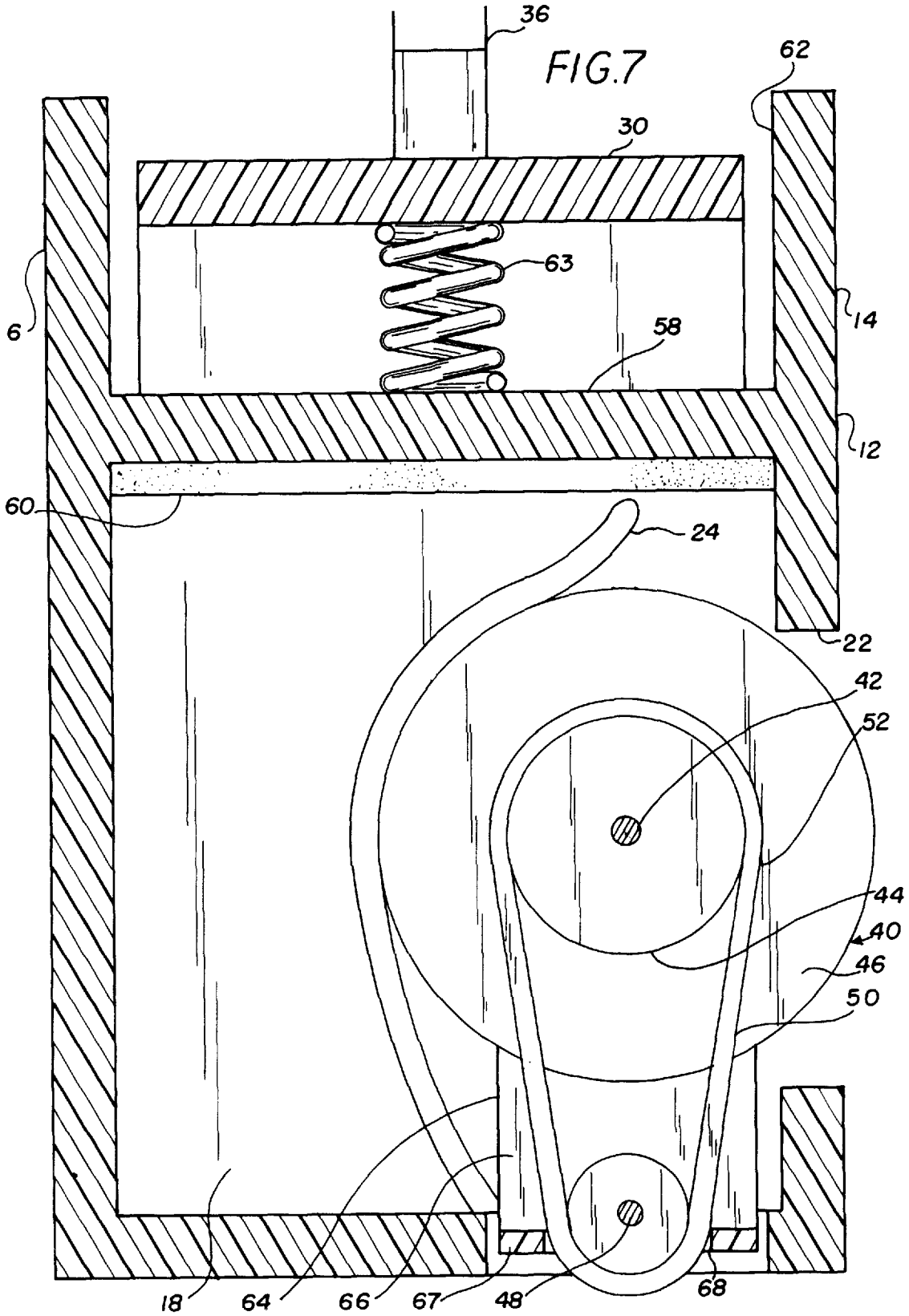
FIG. 7 is a cross-sectional view of the printing assembly taken along line 7—7 shown in FIG. 1.

To afford automatic inking of the indicia, the lower portion of the housing may be equipped with an intermediate plate 58 coupled between the front and rear face thereof. Note FIG. 7. An ink pad 60 is situated on a lower surface of the intermediate plate. It should be noted that the intermediate plate defines a pair of guides 62 between which the top face of the upper potion of the housing slides. To maintain the upper portion of the housing in an elevated orientation with respect to the lower portion when not in use, a spring 63 is situated between the intermediate plate 58 and the top face of the upper portion of the housing. This maintains the exterior surface of the bands that are adjacent the second axle against the ink pad when not in use.

As an option, a U-shaped bracket 64 may be situated about the second axle. The bracket has a pair of side walls 66 pivotally coupled at a first end thereof about the firs axle and further rotatably coupled at a second end thereof with respect to the second axle. The bracket is further equipped with a bottom face 67 with a slot 68 formed therein for allowing the indicia of the band to protrude therethrough. In use, the bracket rotates about the first axle coincidentally with the second axle.

While not illustrated, yet another option associated with the present invention is to increase the width of the flange associated with each pulley and print thereon a decimal number corresponding to the coded indicia situated on the second axle. To prevent misalignment of the indicia of the band and the printed number on the flange, the interior surface of the band may be equipped with a plurality of teeth for engaging teeth formed the pulley.

Figure 5:
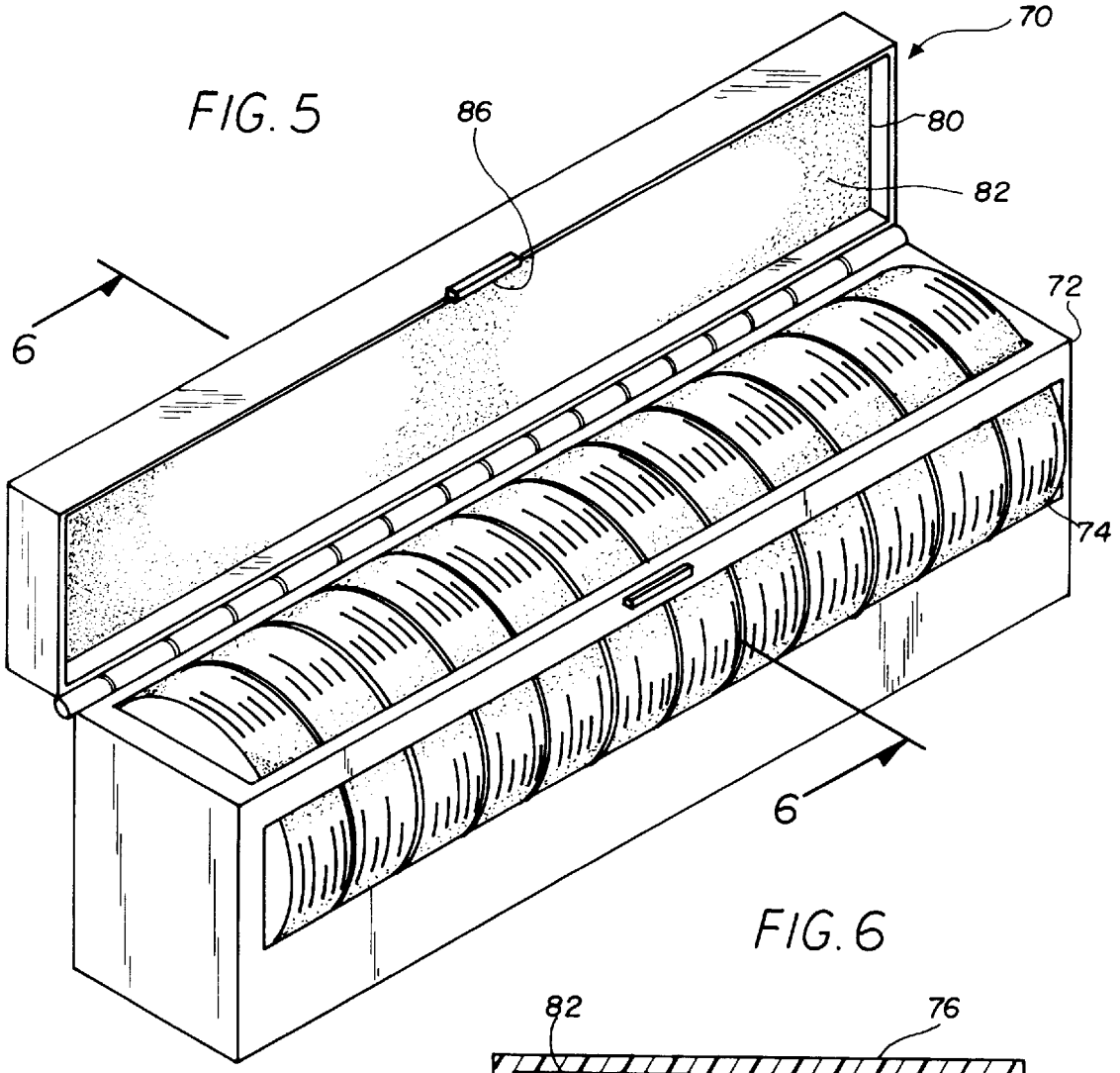
FIG. 5 is a perspective view of an alternate embodiment of the present invention.
Figure 6:
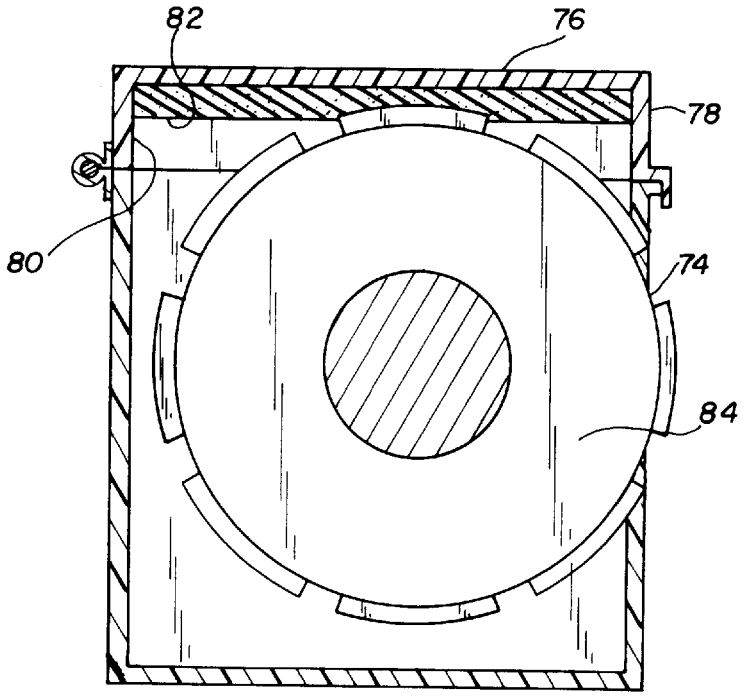
FIG. 6 is a cross-sectional view of the alternate embodiment of the present invention taken along line 6—6 shown in FIG. 5.

As shown in FIGS. 5 & 6, an alternate embodiment 70 is included. The present embodiment includes a housing formed of a rectangular box 72 with a bottom face, a front face, and a pair of side faces defining an interior space and a top opening. The front face has a rectangular cut out 74 formed therein. Also included is a lid with a rectangular top face 76 and a periphery 78 coupled thereto and extending downwardly therefrom defining an inset portion 80. A bottom elongated edge of the periphery is hingeably coupled to a corresponding upper edge of the box. As shown in the Figures, the lid has an ink pad 82 situated within the inset portion thereof. The printing assembly of the present embodiment includes a plurality of dials 84 coaxially coupled between the side faces of the rectangular box with a periphery thereof extending through the rectangular opening and the top opening of the box. It should be understood that each dial has a plurality of indicia formed therein and are independently rotatable thus allowing a desired sequence of indicia to be situated in the top opening of the slot. When the desired sequence of indicia are in the top opening, the lid may be closed thereby inking the same whereat the lid is opened and the indicia of the printing assembly is stamped on an envelope. To maintain the lid in its closed orientation, a locking mechanism 86 is formed on the lid and box.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable, manually actuated mail bar code stamp comprising, in combination:

a hand held housing including a lower portion having a front face, a rear face, and a pair of lower side faces coupled therebetween defining an interior space, a bottom opening, a top opening and upper side openings, the front face having a rectangular cut out formed therein at a lower extent thereof, the lower side faces each having a generally vertical serpentine slot formed therein, the front face and rear face extending beyond the side faces for defining a pair of lips and a slot extending outwardly from the side faces, the housing further having an upper portion with a top face and a pair of side faces defining a bottom opening, the top face having a T-shaped handle integrally coupled thereto at a central extent thereof, the side faces each having a horizontal slot formed at a lower extent thereof, the side faces adapted to be slidably situated within the slots of the lower portion of the housing; and a bar code printing assembly including a first axle coupled between a bottom extent of the side faces of the lower portion of the housing and a plurality of pulleys rotatably coupled in coaxial alignment along the first axle, each pulley having a radially extending flange coupled thereto for allowing manual rotation of the pulley through the rectangular cut out of the lower portion of the housing, the printing assembly further including a second axle having ends situated through the serpentine slot of the lower portion of the housing and the horizontal slot of the upper portion of the housing and a plurality of elastomeric bands situated about an associated pulley and the second axle, the bands having a smooth interior surface and an exterior surface with different indicia formed therein, whereby upon the rotation of the flange of a pulley, the associated band is moved thereby allowing the selective positioning of one of the indicia of the band adjacent the second axle whereat the upper portion of the housing may be lowered with respect to the lower portion thereof thereby precessing the second axle about the first axle and positioning the second axle and the indicia of the bands in the bottom opening of the lower portion of the housing for allowing the indicia to be inked and stamped on an envelope;

said indicia including a plurality of linear protrusions that are spaced and parallel with respect to each other, the linear protrusions having a first length and a second length thereby representing a coded equivalent of a zip code and routing number for facilitating the delivery of mail.

2. A portable, manually actuated mail bar code stamp comprising:

a hand-held, portable housing; and an adjustable bar code printing assembly situated within the housing adapted to allow the printing of indicia;

said indicia including a plurality of linear protrusions that are spaced and parallel with respect to each other, the linear protrusions having a first length and a second length thereby representing a coded equivalent of a zip code and routing number for facilitating the delivery of mail;

wherein the housing including rectangular box with a bottom face, a front face, and a pair of side faces defining an interior space and a top opening, the front face having a rectangular cut out formed therein, the housing further including a lid with a rectangular top face and a periphery coupled thereto and extending downwardly therefrom defining an inset portion with a bottom elongated edge of the periphery being hingeably coupled to a corresponding upper edge of the box, the lid having an ink pad situated within the inset portion thereof, the printing assembly including a plurality of dials coaxially coupled between the side faces of the rectangular box with a periphery thereof extending through the rectangular cut out of the front face and the top opening of the box, each dial having a plurality of indicia formed therein and being independently rotatable.

* * * * *